United States Patent [19]

Salladay

[11] 4,341,246

[45] Jul. 27, 1982

[54] LOG-SPLITTING ATTACHMENT DEVICE

[76] Inventor: James O. Salladay, P.O. Box 224, Fairmount, Ill. 61841

[21] Appl. No.: 196,060

[22] Filed: Oct. 10, 1980

[51] Int. Cl.[3] ..... B27L 7/00

[52] U.S. Cl. ..... 144/193 A; 144/193 R

[58] Field of Search ..... 144/193 R, 193 A, 2 N

[56] References Cited

U.S. PATENT DOCUMENTS

| | | | |
|---|---|---|---|
| 4,073,325 | 2/1978 | Krom, Jr. | 144/193 A |
| 4,155,385 | 5/1979 | Lapointe | 144/193 A |
| 4,246,942 | 1/1981 | Malik | 144/193 A |
| 4,262,714 | 4/1981 | Pratt et al. | 144/193 A |

*Primary Examiner*—W. D. Bray

*Attorney, Agent, or Firm*—David V. Munnis

[57] ABSTRACT

Improvement in a log-splitting attachment device that is adapted to be connected to an apparatus, e.g., a backhoe, having a hydraulically-powered cylinder-piston combination, after removal of the element, e.g., a bucket, normally moved by the piston, to provide a reciprocating log-splitting machine, the improvement including a plunger block element removeably connectable to the free end of the piston and having laterally extending flange means, and further including a frame means removeably connectable to the cylinder of the piston-cylinder combination and having a base plate element and side plate elements for supporting a log to be split, slot means adjacent the base plate for guiding the plunger element during the reciprocation of the piston, and a blade element positioned vertically on the end of the base plate against which a log is forced by the piston-plunger element to split the log.

1 Claim, 4 Drawing Figures

FIG. 1
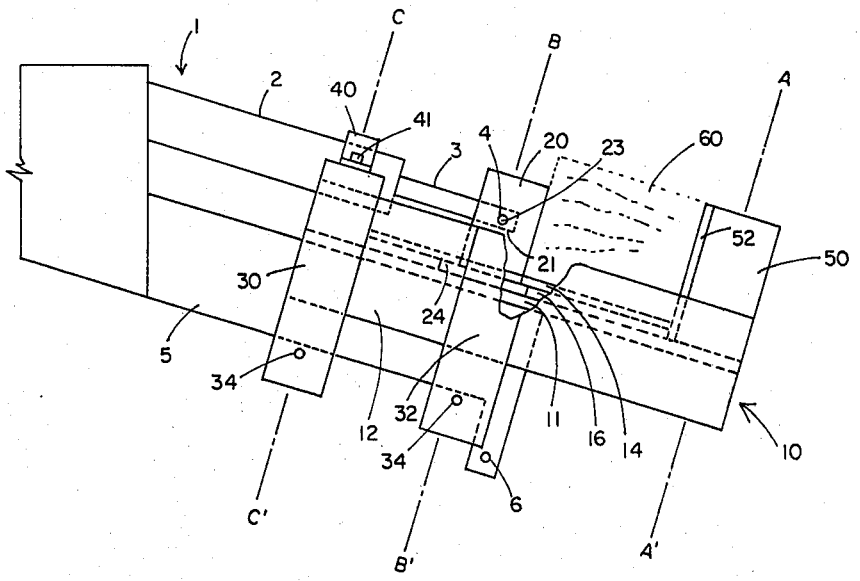
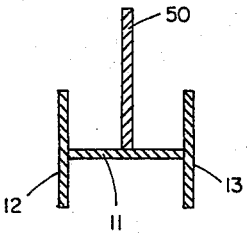
FIG. 2
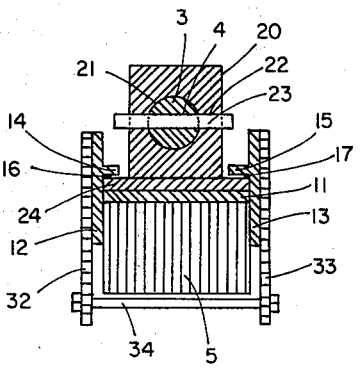
FIG. 3
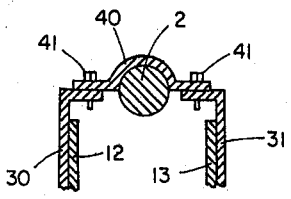
FIG. 4

LOG-SPLITTING ATTACHMENT DEVICE

BACKGROUND OF THE INVENTION

This invention relates to a removeable log-splitting attachment device for an apparatus having a hydraulically-powered cylinder-piston combination.

Numerous examples of mobile, individually-powered, i.e., by an internal combustion engine, log-splitting devices previously have been available. Such devices, while providing generally satisfactory results as log-splitters, have not proved to be totally acceptable, due to their relatively high purchase costs.

It has also previously been suggested to provide an attachment device for machines, such as end loaders, having hydraulically-powered cylinder-piston units in which the piston is employed to force a log against a cutting blade of the attachment to effect a splitting of the log. Such a device is that shown in U.S. Pat. No. 3,780,779. Such an attachment, however, has not proved to be desirable due to drawbacks stemming from an inability to move the base machine with the attachment mounted on same, problems in maintaining the piston in proper alignment, and/or difficulty in maintaining the log to be split in an operable and safe position in the attachment.

Accordingly, a search has continued in the art for improved, relatively inexpensive log-splitting devices.

OBJECTS OF THE PRESENT INVENTION

Hence, it is the primary object of the present invention to provide an improved attachment device for converting an apparatus having a hydraulically-powered cylinder-piston unit into a log-splitting machine.

Another object of the present invention is to provide an improved log-splitting attachment device which is relatively inexpensive.

An additional object of the present invention is to provide an improved log-splitting attachment device for hydraulically-operated piston containing apparatuses that advantageously allows the base apparatuses to be moved with the device mounted thereon.

Still another object of the present invention is to provide an improved log-splitting attachment device for hydraulically-operated piston containing apparatuses that advantageously maintains the piston and the log to be split in a proper, efficient, and safe alignment during the log-splitting operation.

DESCRIPTION OF ACCOMPANYING DRAWINGS

The above and other objects are achieved and are features of the log-splitting attachment device of the present invention which will be described hereinbelow in greater detail with particular reference being made to the accompanying drawings of which:

FIG. 1 is a schematic side view, partially broken away, illustrating an embodiment of the log-splitting attachment device of the present invention mounted in operable position on the cylinder-piston combination of an apparatus containing the latter;

FIG. 2 is a cross-sectional view of the embodiment, shown in FIG. 1, taken along plane A—A';

FIG. 3 is a cross-sectional view of the embodiment, shown in FIG. 1, taken along plane B—B'; and FIG. 4 is a partial cross-sectional view of the embodiment, shown in FIG. 1, taken along (partially) plane C—C'.

DESCRIPTION OF SPECIFIC EMBODIMENTS with reference to the accompanying drawings, in which like numerals refer to like elements, numeral one generally designates a hydraulically-powered cylinder and piston combination of an apparatus conventionally equipped with same, e.g., a backhoe, end loader, and the like, not shown totally, which apparatus also has an arm means 5 for supporting the work piece element, e.g., a bucket, shovel, etc., which normally is moved by cylinder-piston combination 1, such as by being pivoted about a connection 6 on arm 5.

Cylinder-piston combination 1 has a cylinder 2 and a piston 3 provided at its forward free end with means, e.g., a lateral opening 4 therethrough for receiving a connecting pin and the like, for connecting piston 3 to the work piece, e.g., a bucket, shovel, etc., normally moved by piston 3 in the conventional apparatus.

In accordance with the present invention, cylinder-piston combination 1 is provided with a log-splitting attachment device which comprises a frame means designated generally numeral 10 and a plunger block means 20.

Plunger block means 20 is adapted to be removeably connected to the free end of piston 3, such as by being provided with a longitudinal opening 21 therein adapted to slideably receive the free end of piston 3 and by being further provided with a lateral opening 22 therein to be adapted to receive therein, when opening 22 is aligned with opening 4 in the end of piston 3, a connection means, e.g., a connecting pin 23, which may be removed when it is desired to detach the attachment device of the present invention from the apparatus.

In accordance with the present invention, plunger block element 20 is further provided with a laterally extending flange element means, such as a plate element 24 fixedly attached to its base and defining on each side flanges which laterally extend into slot means 16 and 17 provided in frame means 10 as hereinbelow described.

By means of the utilization of the plunger block element with such flange means in the device of the present invention, a relatively large surface is provided for abutting a log 60 placed in the device for splitting and the path of travel of plunger element 20 is controlled during the splitting operation, with the result that the device of the present invention advantageously is more efficient and significantly safer, e.g., a log and/or piston 3 is not apt to move laterally of the normal axis of piston 3 during the extension of piston 3 during the splitting operation, than prior attachment devices.

In accordance with the present invention frame means 10 includes a base plate element 11, upon which a log 60 to be split is positioned, side plate elements 12 and 13 positioned essentially vertically on each side of base plate element 11, for retaining a log 60 against lateral movement, and slot means provided above and adjacent base plate element 11, e.g., as shown, by providing inwardly projecting flange elements 14 and 15 on side plate elements 12 and 13, respectively, and in such spaced relationship to base plate 11 to define thereby slots 16 and 17 longitudinally of frame means 10, which slot means 16 and 17 are adapted to slideably receive and guide plunger block element, via flange means 24 thereof, adjacent base plate element 11 during the reciprocation of piston 3 and block element 20.

Frame means 10 further includes a cutting blade element 50 having a cutting edge 52 positioned vertically on and adjacent the end of base plate element 11 removed from the free end of piston 3. Blade element 50 is adapted to cause a log 60, which placed on base plate element 11 between plunger 20 and blade 50, to be split when piston 3 is extended from cylinder 2 a cooperatively effective distance to force log 60 past cutting blade 50.

In accordance with the present invention, frame means 10 further includes means for attaching the same to cylinder 2, e.g., as shown, by providing a connecting bracket element 40, which cooperatively fits over the top of cylinder 2, and positioning angled plates 30 and 31 on side plate elements 12 and 13, respectively, so that bracket element 40, via conventional connection means, e.g., nut-bolt combinations 41, is fastened firmly and releaseably within frame means 10. In instances, wherein the apparatus to which frame means 10 is attached also has a conventional arm, e.g., arm 5, as shown, frame means also suitably may have supplemental connection means attaching the same to arm 5, such as extending plates 30 and 31 to reach below arm 5 where connection means, e.g., nut and bolt combination 34, fastens the same to arm 5, and optionally providing an additional more forwardly positioned set of connection plates, e.g., plates 32 and 33, which similarly to plates 30 and 31, are anchored to arm 5 by suitable means, e.g., a nut-bolt combination 34.

In operation of the present device, the work piece member of the apparatus normally present, e.g., a bucket, shovel, etc., is removed and frame means 10 and plunger element 20 are mounted on cylinder-piston combination 1 as above described. Piston 3 is moved, if necessary, by retracting the same within cylinder 2 to provide sufficient space between plunger block element 20 and cutting blade 50 to insert therebetween a log 60. Log 60 will be retained in place by side plate elements 12 and 13, and, if desired piston 3 may be advanced slightly to allow plunger block element 20 to abut the end of log 60. This is an improved feature of the present device as compared to prior attachments, wherein a naked end of plunger 3 is utilized. Then, piston 3 need only be extended further to cause log 60 to be forced past cutting blade 50 and split thereby. Piston 3 then may be retracted, and the operation repeated to split additional logs.

Actuation of piston 3 is accomplished by use of the controls provided with the apparatus' conventional hydraulic system. Where desired, such operation of such controls may be achieved from the location of the log-splitting attachment, by means of extension rods and the like, not shown.

What is claimed is:

1. In a log-splitting attachment device that is adapted to be connected to an apparatus having a hydraulically-powered cylinder-piston combination, after removal of the work piece element normally moved by said cylinder-piston combination, to provide a reciprocating log-splitting machine, the improvement comprising:

(a) a plunger block means adapted to be removeably connected to the forward free end of said piston, said plunger means including laterally extending flange means, (b) a frame means including:

(1) a base plate element upon the upper surface of which a log to be split may be placed, (2) side plate elements positioned essentially vertically on each side of said base plate element for retaining a log to be split against lateral movement, (3) slot means provided above and adjacent said base plate element, said slot means being adapted to slideably receive said flange means of said plunger means, to thereby guide and retain said plunger means adjacent said base plate element during the reciprocation of said piston, (4) a cutting blade element positioned vertically on and adjacent the end of said base plate element removed from said cylinder, and (5) means for connecting said frame means removeably to said cylinder, whereby a log placed on said base plate element between said plunger means and said cutting blade element is split upon extension of said piston from said cylinder by forcing said log against and sufficiently past said cutting blade element.

* * * * *